US012012767B2

(12) United States Patent
Miller

(10) Patent No.: US 12,012,767 B2
(45) Date of Patent: Jun. 18, 2024

(54) WIDE-FORMAT TILE SHIM

(71) Applicant: Gregory Alan Miller, Bloomington, MN (US)

(72) Inventor: Gregory Alan Miller, Bloomington, MN (US)

( * ) Notice: Subject to any disclaimer, the term of this patent is extended or adjusted under 35 U.S.C. 154(b) by 141 days.

(21) Appl. No.: 17/569,413

(22) Filed: Jan. 5, 2022

(65) Prior Publication Data

US 2022/0213699 A1 Jul. 7, 2022

Related U.S. Application Data

(60) Provisional application No. 63/133,929, filed on Jan. 5, 2021.

(51) Int. Cl.
*E04F 21/22* (2006.01)
*E04F 15/02* (2006.01)

(52) U.S. Cl.
CPC ..... *E04F 21/22* (2013.01); *E04F 15/0215* (2013.01)

(58) Field of Classification Search
CPC ..... E04F 21/22; E04F 15/0215; E04F 15/182
See application file for complete search history.

(56) References Cited

U.S. PATENT DOCUMENTS 2,852,932 A * 9/1958 Cable ..... E04F 15/08 52/387
3,238,682 A * 3/1966 Tracy ..... E04F 15/08 52/387
4,712,309 A * 12/1987 Kingston ..... E04F 21/04 33/562
4,807,412 A * 2/1989 Frederiksen ..... E04F 15/105 52/180
7,958,681 B2 * 6/2011 Moller, Jr. ..... E01C 5/20 52/592.1
8,266,849 B2 * 9/2012 Bravo ..... E04F 15/105 52/177
2004/0177578 A1 * 9/2004 Casimaty ..... A01G 9/033 52/653.1
2015/0303586 A1 * 10/2015 Hafenrichter ..... H01Q 1/40 343/893
2018/0038055 A1 * 2/2018 Szekely ..... E01C 5/001
2019/0292795 A1 * 9/2019 Busby ..... E04F 15/02044

FOREIGN PATENT DOCUMENTS

EP 2476818 A2 * 7/2012 ..... E04F 15/0215
GB 2133818 A * 8/1984 ..... E04C 2/30
KR 20230032176 A * 3/2023

* cited by examiner

*Primary Examiner* — Babajide A Demuren

(57) ABSTRACT

A wide-format tile shim includes a shim body, a plurality of length grooves, a plurality of width grooves, and a plurality of openings. The plurality of length grooves is evenly distributed along the shim body and traverses into the shim body. The plurality of width grooves is evenly distributed across the shim body and traverses into the shim body. Each of the plurality of length grooves is positioned perpendicular to each of the plurality of width grooves as the plurality of openings traverses from a front surface of the shim body to a rear surface of the shim body. Each of the plurality of opening is positioned adjacent to an intersecting length groove from the plurality of length grooves and an intersecting width groove from the plurality of width grooves thus evenly spacing the plurality of opening within the shim body.

4 Claims, 9 Drawing Sheets

WIDE-FORMAT TILE SHIM

The current application claims a priority to the U.S. Provisional Patent application Ser. No. 63/133,929 filed on Jan. 5, 2021.

FIELD OF THE INVENTION

The present invention generally relates to a flat, wide-format, perforated shim for tiles. More specifically, the present invention can be used when installing floor tiles or wall tiles to offset a thickness difference between two different tile sets.

BACKGROUND OF THE INVENTION

In the construction world, there are various devices that individuals use in order to assist in the installation of multiple types of tiles. Tile spacers can be used to keep the tiles aligned correctly when placed on the walls or floors. Additionally, individuals use tile levelers and plastic wedges to hold the tile in certain positions on the wall or floor ensuring that the tiles stay flat. Recently, new devices have come to market to assist in keeping large format tile in position on the wall or floor ensuring that the tile has the same plane height as the surrounding tiles to provide a clean finished look and prevent tile offsetting. Although there are solutions present for a large format tile, there is a lack of solutions for thinner and smaller accent tiles, mosaic tiles, to be aligned on the same plane with the surrounding tiles. An increasingly popular option, mosaic tile is usually very small and thin individual tile pieces connected and glued together by a flimsy fiberglass mesh backing in a 12 inch by inch matrix.

When installing thinner accent tiles such as mosaic tiles, individuals currently have two main ways to deal with the issue of ensuring the tiles are installed in the same plane with the surrounding tiles. The first way that individuals attempt to deal with the issue is waiting for overnight drying of the mortar. This is accomplished by tiling up to the point of the thin mosaic tiles and placing a spacer or cleat in place of the thin mosaic tiles and then continuing to tile the space above this gap. While allowing the tile to dry overnight, a trench is left between the two sets of tiles, where the individual will remove the temporary spacer and add more mortar and attempt to gauge the correct height needed to install the thin mosaic tile. The main issue with this method is that valuable time is wasted by waiting overnight for the original tiles to dry before starting to work on the remaining mosaic tiles. The alternative method is to build up the mortar in the area for the thin mosaic tile without waiting overnight for it to dry. This method is accomplished by spreading the mortar in the same fashion for the large format tiles and by building up a thick wet mortar base for the thin mosaic tiles to be placed on immediately. The issue with this method is that the copious use of mortar usually results in the thin mosaic tiles shifting around or having mortar get squeezed out though the grout lines. This method ends up taking more time to clean up the excess mortar and could also result in a ruined project from uneven tiles. Lastly, large tiles can not be placed over a fresh mosaic tile installation until it has dried overnight.

It is an objective of the present invention to solve these issues by placing a perforated shim in place of part of the mortar beneath the thin mosaic tiles. This allows the thin mosaic tiles to have a firm base to be placed on to prevent tiles from becoming uneven while drying and allows the installation process to be reduced in time without sacrifice of quality in the outcome.

SUMMARY OF THE INVENTION

The present invention is a wide-format perforated shim that assists in the tile installation process. The wide-format shim provides solutions to the issues of drying time and improper installation of thin mosaic tiles when surrounded by large format tiles, which are usually thicker. During tile installation, the individual can easily snap the perforated shim to match the shape of the area where the mosaic till is laid and place it in the gap between the surrounding large format tiles, bedding the perforated shim into a thin layer of mortar. Then, another thin layer of mortar is troweled on and the mosaic tile is laid on top of the perforated shim. Thus, instead of having to set the thin mosaic tiles over a thick and saggy layer of mortar, the perforated shim acts as a filler, significantly reducing the amount of mortar needed and giving a rigid backing directly behind the mosaic tile. The perforated shim acts not only as a filler but can be used as a rigid vertical support for the large and heavy tiles if they are placed above the mosaic tile on a wall, thus allowing a continuation of tiling without waiting for drying overnight. The perforations in the perforated shim provide channels for mortar to flow so that the perforated shim can be easily pushed into proper alignment and depth.

DETAIL DESCRIPTIONS OF THE INVENTION

All illustrations of the drawings are for the purpose of describing selected versions of the present invention and are not intended to limit the scope of the present invention.

The present invention is a wide-format tile shim that allows thin mosaic tiles to be level with surrounding large format tiles or offset thickness difference between two different tiles. More specifically, the present invention can fit various sized gaps for an individual's different needs with slight adjustments and provide a rigid base for the thin mosaic tiles to remain level with the surrounding large format tiles that are generally thicker than the thin mosaic tiles. The present invention is preferably made of any type of semi-rigid plastic that is resistant to water and chemical to ensure that the shape of the present invention is not unintentionally manipulated during the installation process.

Figure 1:
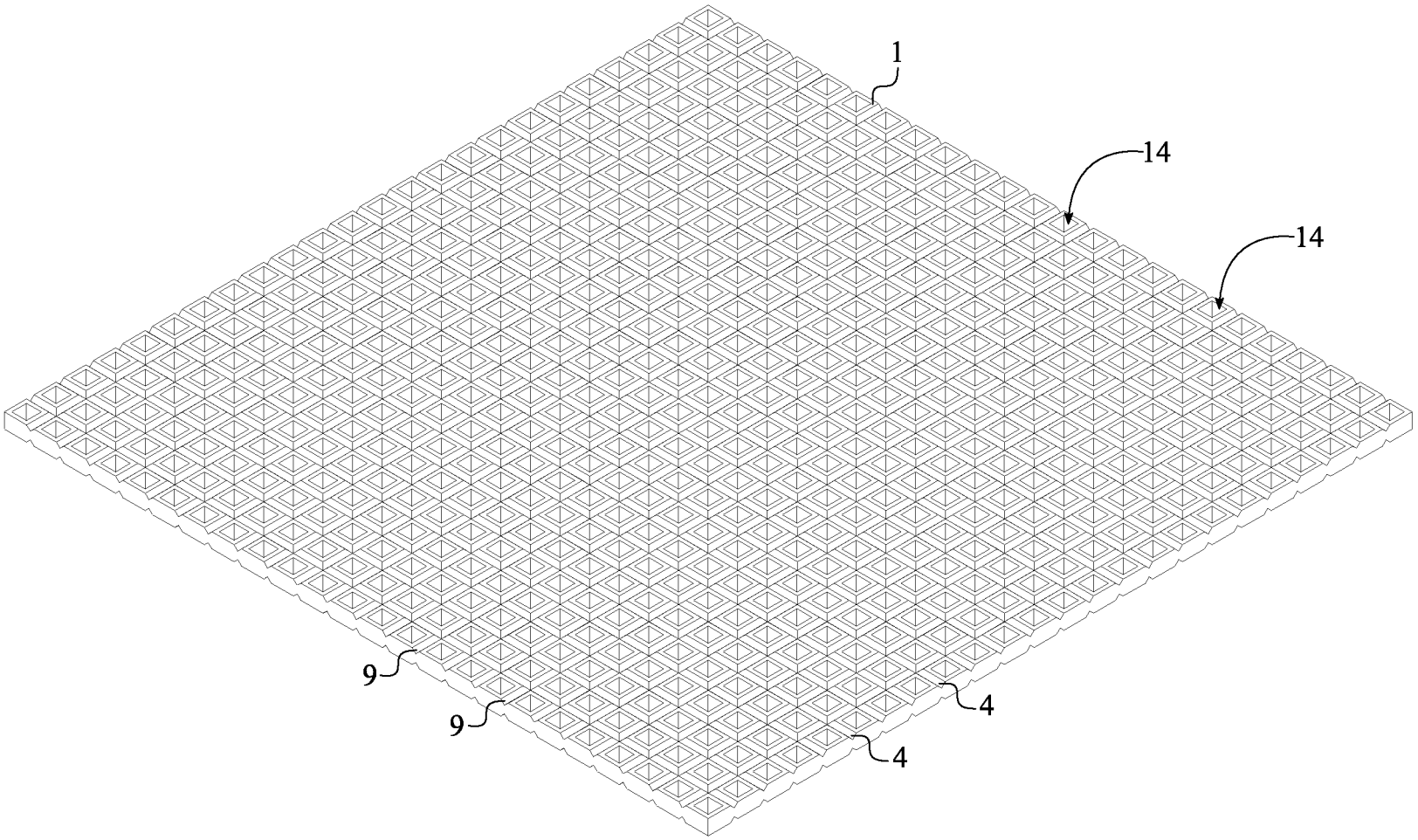
FIG. 1 is a perspective view of the present invention.
Figure 2:
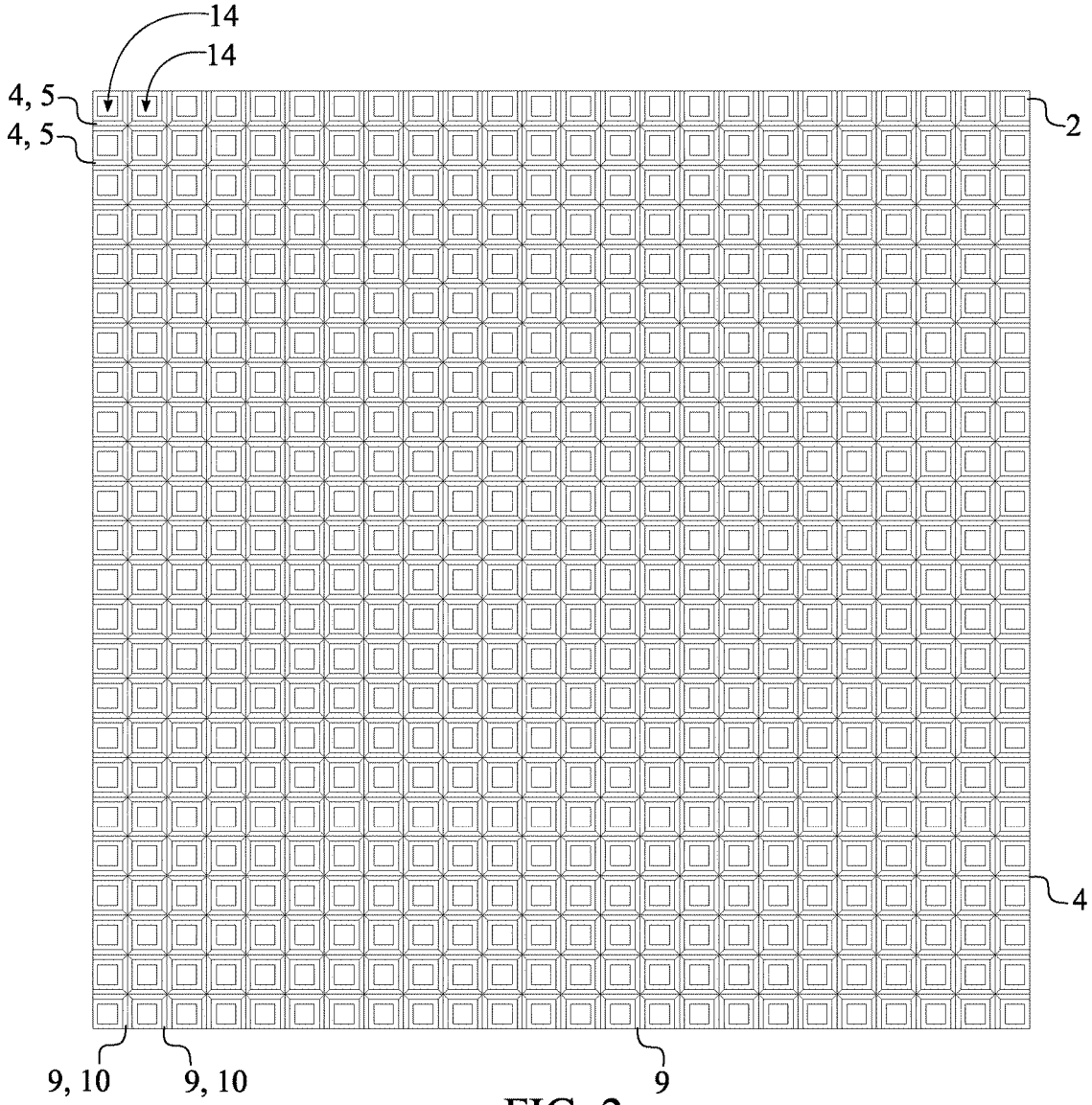
FIG. 2 is a front view of the present invention.
Figure 3:
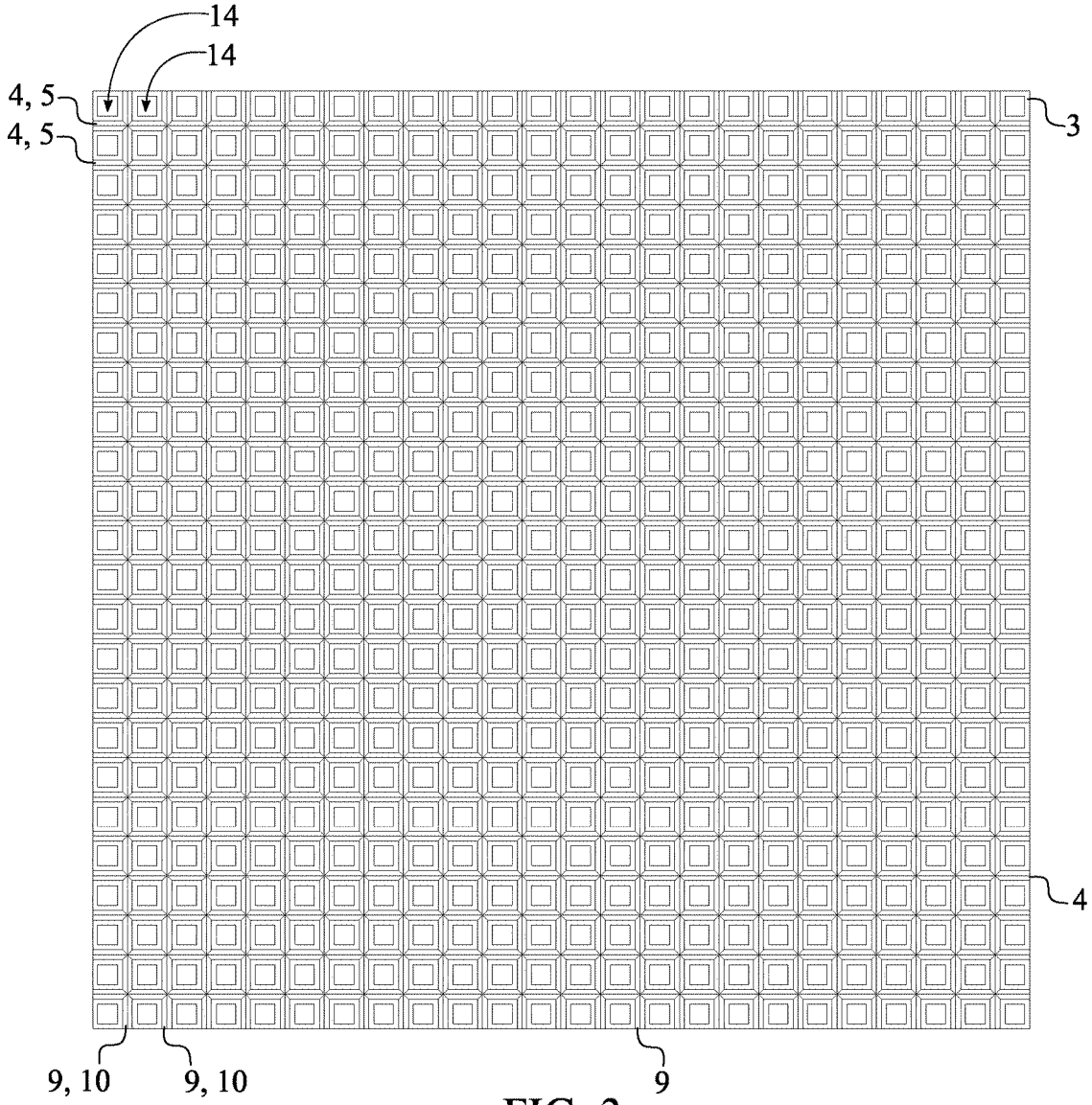
FIG. 3 is a rear view of the present invention.

As shown in FIGS. 1-3, the present invention comprises a shim body 1, a plurality of length grooves 4, a plurality of width grooves 9, and a plurality of openings 14. In reference to the general configuration of the present invention, the plurality of length grooves 4 is evenly distributed along the shim body 1 and traverses into the shim body 1. The plurality of length grooves 4 provides multiple cutlines along the shim body 1 so that the user can adjust the height of the shim body 1 to match the height of the gap that need to be fitted. The plurality of width grooves 9 is evenly distributed across the shim body 1 and traverses into the shim body 1. The plurality of width grooves 9 provides multiple cutlines across the shim body 1 so that the user can adjust the length of the shim body 1 to match the length of the gap that need to be fitted. Each of the plurality of length grooves 4 is positioned perpendicular to each of the plurality of width grooves 9 thus allowing the user to customize the shim body 1 to any preferred shape. The plurality of openings 14 traverses from a front surface 2 of the shim body 1 to a rear surface 3 of the shim body 1 so that the thin-set mortar can penetrate through the shim body 1 to allow a monolithic bond between the mosaic tiles and the back wall via the present invention. Each of the plurality of openings 14 is positioned adjacent to an intersecting length groove 5 from the plurality of length grooves 4 and an intersecting width groove 10 from the plurality of width grooves 9. In other words, the intersecting length groove 5 and the intersecting width groove 10 perpendicularly intersects with each other throughout the shim body 1 as each of the plurality of openings 14 is positioned adjacent to the corresponding width groove and the corresponding length groove. Resultantly, the plurality of openings 14 is able to allow uniform penetration of thin-set mortar through the shim body 1.

In reference to FIGS. 2-3, the shim body 1 is a rectangular body since the majority of tiles are manufactured into rectangular shape. Preferably, the shim body 1 is a 12"×12" square shape body; however, the shim body 1 is not limited to the aforementioned dimensions and can be manufactured into any other industry standard dimensions. Preferably, a thickness of the shim body 1 ranges from ⅛ inch to ¼ inch to accommodate thin mosaic tiles. The front surface 2 and the rear surface 3 of the shim body 1 have rough textured surfaces thus allowing for a more cohesive bond between the present invention and the various adhesives or thin-set that may be used in the tile installation process.

In reference to FIG. 2, the plurality of length grooves 4 traverses into the front surface 2 of the shim body 1. The plurality of width grooves 9 traverses into the front surface 2 of the shim body 1. As a result, the user can cut along the plurality of length grooves 4 and/or the plurality of width grooves 9 to adjust the shape and size of the shim body 1 with respect to the front surface 2.

In reference to FIG. 3, the plurality of length grooves 4 traverses into the rear surface 3 of the shim body 1. The plurality of width grooves 9 traverses into the rear surface 3 of the shim body 1. As a result, the user can cut along the plurality of length grooves 4 and/or the plurality of width grooves 9 to adjust the shape and size of the shim body 1 with respect to the rear surface 3.

Furthermore, the plurality of length grooves 4 of the front surface 2 and the plurality of length grooves 4 of the rear surface 3 are symmetrical about a frontal plane of the shim body 1. The plurality of width grooves 9 of the front surface 2 and the plurality of width grooves 9 of the rear surface 3 are symmetrical about the frontal plane of the shim body 1. As a result, when the user cuts along an arbitrary groove of the plurality of length grooves 4 from the front surface 2, a corresponding grove of the plurality of length grooves 4 from the rear surface 3 is also simultaneously cut through the cutting device. Similarly, when the user cuts along an arbitrary groove of the plurality of width grooves 9 from the front surface 2, a corresponding grove of the plurality of width grooves 9 from the rear surface 3 is also simultaneously cut through the cutting device.

Furthermore, each of the plurality of length grooves 4 is evenly spaced at ½ inch interval with respect to the front surface 2 and the rear surface 3. Each of the plurality of width grooves 9 is evenly spaced at ½ inch interval with respect to the front surface 2 and the rear surface 3. Even spacing of the plurality of length grooves 4 and the plurality of width grooves 9 enables the user to trim the shim body 1 to any desired sized to fill in the gap between the surrounding large format tiles.

Figure 4:
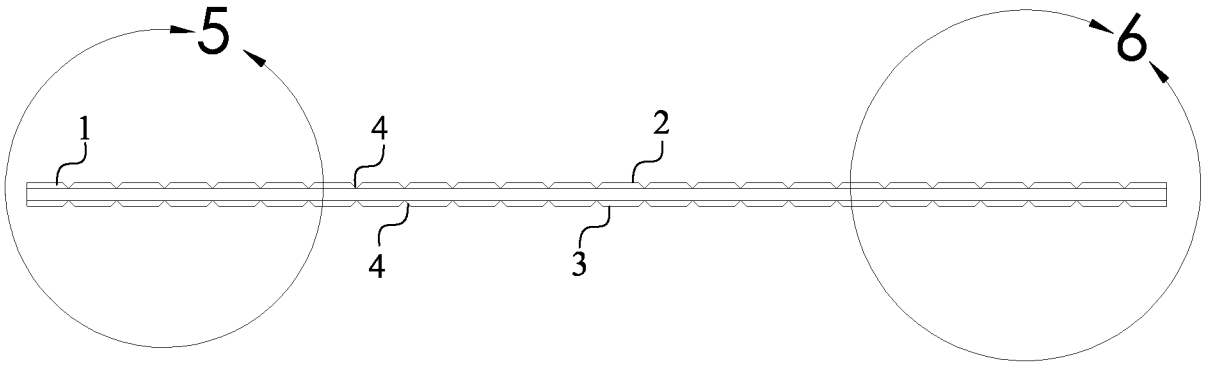
FIG. 4 is a side view of the present invention.
Figure 5:
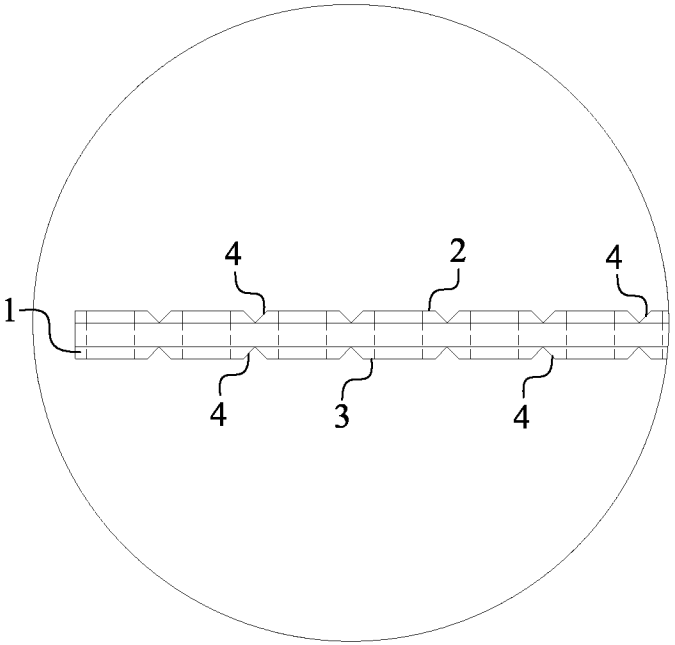
FIG. 5 is a detailed view of the present invention taken about circle 5 in FIG. 4 showing the first outer length-groove and the plurality of intermediate length-grooves.
Figure 6:
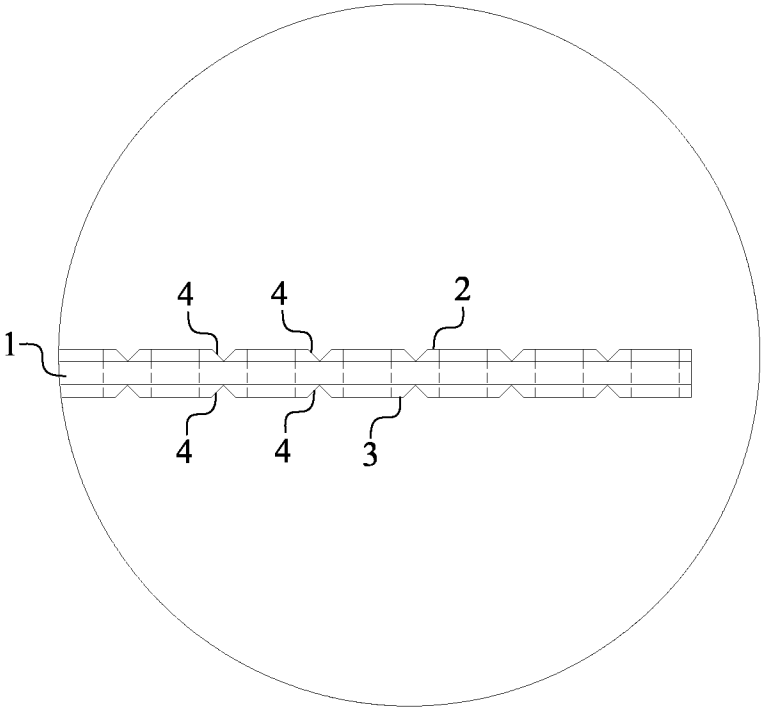
FIG. 6 is a detailed view of the present invention taken about circle 6 in FIG. 4, showing the second outer length-groove and the plurality of intermediate length-grooves.

In reference to FIGS. 4-6, each of the plurality of length grooves 4 is shaped into a V-shaped groove so that the user can easily run a utility knife to perform a straight cut along the V-shaped groove. The plurality of length grooves 4 is extended parallel to a first length edge and a second length edge of the shim body 1 as the first length edge and the second length edge define the outermost length edges of the shim body 1. In other words, each of the plurality of length grooves 4 is evenly spaced at ½ inch interval in between the first length edge and the second length edge. Furthermore, the first length edge delineates a right angle between the front surface 2 and the rear surface 3 of the shim body 1. The second length edge delineates a right angle between the front surface 2 and the rear surface 3 of the shim body 1, wherein the first length edge and the second length edge are oppositely positioned of each other about the shim body 1.

Figure 7:
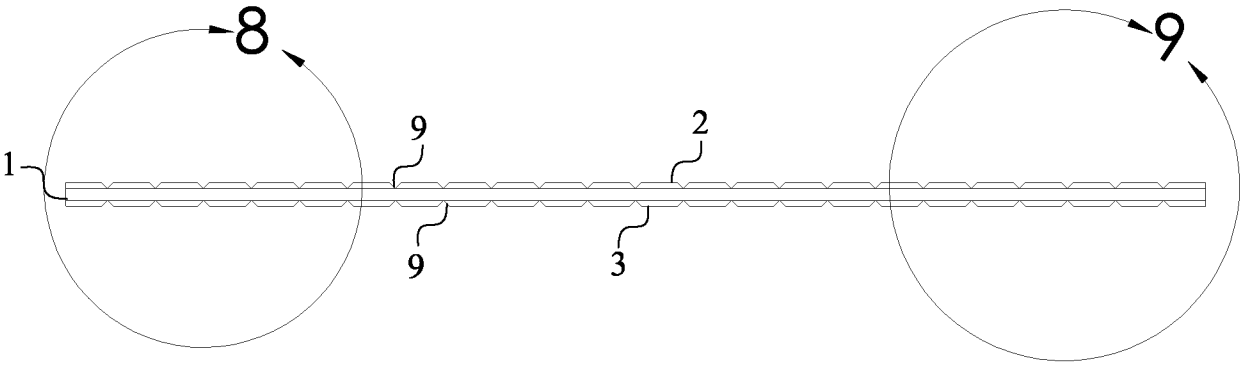
FIG. 7 is another side view of the present invention.
Figure 8:
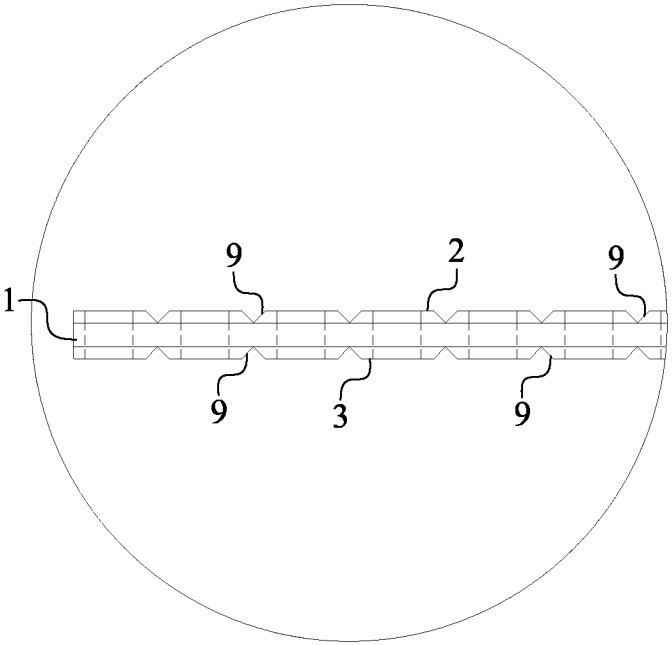
FIG. 8 is a detailed view of the present invention taken about circle 8 in FIG. 7, showing the first outer width-groove and the plurality of intermediate width-grooves.
Figure 9:
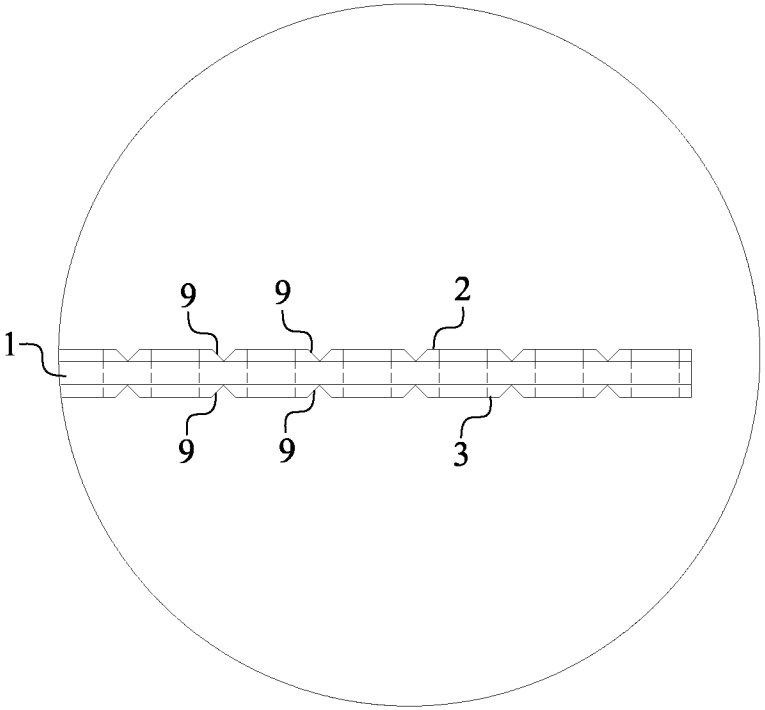
FIG. 9 is a detailed view of the present invention taken about circle 9 in FIG. 7, showing the second outer width-groove and the plurality of intermediate width-grooves.

In reference to FIGS. 7-9, each of the plurality of width grooves 9 is shaped into a V-shaped groove so that the user can easily run a utility knife to perform a straight cut along the V-shaped groove. The plurality of width grooves 9 is extended parallel to a first width edge and a second width edge of the shim body 1 as the first width edge and the second width edge define the outermost width edges of the shim body 1. In other words, each of the plurality of width grooves 9 is evenly spaced at ½ inch interval in between the first width edge and the second width edge. Furthermore, the first width delineates a right angle between the front surface 2 and the rear surface 3 of the shim body 1. The second width edge delineates a right angle between the front surface 2 and the rear surface 3 of the shim body 1, wherein the first width edge and the second width edge are oppositely positioned of each other about the shim body 1.

Alternatively, the plurality of length grooves 4 comprises a first outer length-groove, a plurality of intermediate length-grooves, a second outer length-groove that are extended parallel to the first length edge and the second length edge of the shim body 1. More specifically, the plurality of intermediate length-grooves is positioned in between the first outer length-groove and the second outer length-groove. The first outer length-groove and the second outer length-groove are shaped into a chamfer groove as they align with the outermost length edges of the shim body 1. Each of the plurality of intermediate length-grooves is shaped into a V-shaped groove so that the user can easily run a utility knife to perform a straight cut along the V-shaped groove.

Alternatively, the plurality of width grooves 9 comprises a first outer width-groove, a plurality of intermediate width-grooves, a second outer width-groove that are extended parallel to the first width edge and the second width edge of the shim body 1. More specifically, the plurality of intermediate width-grooves is positioned in between the first outer width-groove and the second outer width-groove. The first outer width-groove and the second outer width-groove are shaped into a chamfer groove as they align with the outermost width edges of the shim body 1. Each of the plurality of intermediate width-grooves is shaped into a V-shaped groove so that the user can easily run a utility knife to perform a straight cut along the V-shaped groove.

In reference to FIGS. 2-3, each of the plurality of openings 14 is preferably shaped into a square shape to provide the maximum thin-set penetration; however, each of the plurality of openings 14 can be shaped into any other types of geometric shapes other than the square shape. Once the user has determined the shape and size of the shim body 1 that best suits the gap, the user can fill the gap with, mortar or another type of adhesive before placing the shim body 1 within the gap. The plurality of openings 14 allows the mortar to cover more space in a controlled manner and allows the mortar to be squeezed through the shim body 1. Then, the thin mosaic tile can be placed adjacent to the front surface 2 of the shim body 1 to be leveled with the surrounding large format tiles. Resultantly, the shim body 1 provides a stronger bond to the thin mosaic tiles and prevents shifting while drying to create an even surface and a professional finish.

Although the invention has been explained in relation to its preferred embodiment, it is to be understood that many other possible modifications and variations can be made without departing from the spirit and scope of the invention as hereinafter claimed.

What is claimed is:

1. A wide-format tile shim comprising:

a shim body;

a plurality of length grooves;

a plurality of width grooves;

a plurality of openings;

the shim body comprising a front surface and a rear surface;

the plurality of length grooves comprising a plurality of front length grooves and a plurality of rear length grooves;

the plurality of width grooves comprising a plurality of front width grooves and a plurality of rear width grooves;

the shim body being a uniform continuous flat piece of semi-rigid material;

each of the plurality of length grooves and each of the plurality of width grooves being an elongated V-shaped groove;

each of the plurality of length grooves and each of the plurality of width grooves being configured to tear off at least one selected piece of the shim body;

the plurality of front length grooves and the plurality of front width grooves traversing into the shim body from the front surface;

the plurality of front length grooves and the plurality of front width grooves being arranged in a front groove grid pattern across the front surface;

the plurality of rear length grooves and the plurality of rear width grooves traversing into the shim body from the rear surface;

the plurality of rear length grooves and the plurality of rear width grooves being arranged in a rear groove grid pattern across the rear surface;

each of the plurality of front length grooves being positioned colinear to a corresponding rear length groove from the plurality of rear length grooves;

each of the plurality of front width grooves being positioned colinear to a corresponding rear width groove from the plurality of rear width grooves;

each of the plurality of openings traversing into the front surface, through the shim body, and to the rear surface;

each of the plurality of openings being positioned within a corresponding space from the front groove grid pattern and a corresponding space from the rear groove grid pattern; and the shim body, the plurality of length grooves, the plurality of width grooves, and a plurality of openings being configured to be integrated into a quantity of mortar beneath at least one mosaic tile as a filler for the quantity of mortar and as further structural support for the at least one mosaic tile.

2. The wide-format tile shim as claimed in claim 1, wherein the shim body is a rectangular body.

3. The wide-format tile shim as claimed in claim 1, wherein a thickness of the shim body ranges from ⅛ inch to ¼ inch.

4. The wide-format tile shim as claimed in claim 1 comprising:

each of the plurality of length grooves being evenly spaced at ½ inch interval; and each of the plurality of width grooves being evenly spaced at ½ inch interval.

* * * * *